United States Patent [19]

Li et al.

[11] 4,180,214

[45] Dec. 25, 1979

[54] CARTRIDGE TAKEUP APPARATUS

[75] Inventors: Hsin L. Li, Parsippany; Hendrikus J. Oswald, Morristown; Robin B. Mumford, Colts Neck, all of N.J.

[73] Assignee: Allied Chemical Corporation, Morris Township, Morris County, N.J.

[21] Appl. No.: 966,987

[22] Filed: Dec. 6, 1978

[51] Int. Cl.[2] ..... B65H 54/76

[52] U.S. Cl. ..... 242/47; 28/289; 242/1; 242/83; 242/159

[58] Field of Search ..... 242/47, 53, 82, 83, 242/1, 2, 159; 28/289

[56] References Cited

U.S. PATENT DOCUMENTS

| | | | |
|---|---|---|---|
| 918,235 | 4/1909 | Wendtland | 242/83 |
| 1,008,993 | 11/1911 | Seward | 242/83 |
| 1,676,606 | 7/1928 | Albright, Jr. | 242/83 |
| 1,745,644 | 2/1930 | Royle | 242/82 |
| 3,236,467 | 2/1966 | Short et al. | 242/83 X |
| 3,750,974 | 8/1973 | Dibrell | 242/47 X |
| 3,817,466 | 6/1974 | Reynard et al. | 242/83 X |
| 3,822,045 | 7/1974 | Johnson | 242/83 |
| 4,142,280 | 3/1979 | Feffer | 242/83 X |

*Primary Examiner*—Stanley N. Gilreath
*Attorney, Agent, or Firm*—Ernest A. Polin; James Riesenfeld

[57] ABSTRACT

An improved apparatus for taking up textured yarn plugs into a cartridge is provided. The apparatus comprises a spiral-walled cartridge and means for rotating the cartridge about a vertical axis while moving it laterally. In operation, the cartridge is rotated beneath a yarn texturizer as textured yarn in plug form is deposited therein in orderly layers. Even with high-speed texturizers, cartridge speed is low. After the plugs have been deposited, the cartridge may be removed, and the yarn plugs may be pulled out for knitting or weaving.

9 Claims, 9 Drawing Figures

CARTRIDGE TAKEUP APPARATUS

BACKGROUND OF THE INVENTION

1. Field of the Invention

This invention relates to an improved apparatus and process for taking up textured yarn plugs into a cartridge. More particularly, this invention relates to an improved apparatus and process for taking up textured yarn plugs in an orderly arrangement, such that the yarn can be removed thereafter without entanglement.

2. Description of the Prior Art

In a high-speed texturizing process, high-speed winders are required to take up the textured yarns. These winders are relatively expensive, are of questionable reliability, and are extremely noisy. Therefore, an alternative to these high-speed winders is desirable.

Accumulating yarn in plug form is known in the prior art; for example, in U.S. Pat. No. 3,172,185 of Mar. 9, 1965 to Langway and Billings; U.S. Pat. No. 3,316,609 of May 2, 1967 to C. J. Russo; U.S. Pat. No. 3,341,911 of Sept. 19, 1967 to J. W. Smith and U.S. Pat. No. 3,441,989 of May 6, 1969 to R. G. Clarkson et al. Each of these prior art patents suffers from one or more of the following disadvantages: complex equipment is needed to convey the yarn plug into the receiver; the packaging equipment must be tailored to accommodate a particular texturizing apparatus; and since all the yarn is deposited into a single receiving chamber, there is a tendency for the yarn to become tangled on removal. U.S. Pat. No. 3,058,690 of Oct. 16, 1962 to Russo et al. and U.S. Pat. No. 3,980,176 to B. A. Boggs disclose a plug storage apparatus which requires the plugs to be wrapped in a plastic tape, forming a sausagelike tube. After the yarn is removed, the wrap must either be discarded or rewound for reuse, which procedures are complex and inconvenient.

3. Summary of the Invention

One object of this invention is to provide a cartridge takeup apparatus as a replacement for costly high speed winders.

Another object of this invention is to provide a takeup apparatus which can operate at yarn speeds for which high speed winders are unavailable (i.e., speed >6000 m per minute).

Another object of this invention is to provide a yarn plug takeup apparatus from which the yarn can be removed without entanglement, as well as a process for removal of the yarn.

In accordance with the present invention, an improved takeup apparatus for packaging yarn plugs comprises a spiral-walled cartridge for receiving yarn plugs from a yarn texturizer; a support for the base of said cartridge, said support having a spiral wall extending downward, the shape of said wall corresponding substantially to the shape of said cartridge wall; a shaft upon which said support is mounted; means for driving said support around said shaft by contacting the spiral wall of said support with a driving means; means for applying a lateral force to said shaft to hold the spiral wall of said support in non-slip contact with said driving means; means for sensing the lateral position of said support; and means for changing reversibly the direction of said lateral force such that the contact point of the driving means shifts from a point on the inside of the support spiral wall to a point on the outside of the wall.

In operation, the process comprises placing a cartridge having a spiral storage area beneath the texturizer outlet; causing the yarn plugs to fall along one side of the spiral storage area by rotating said cartridge in one direction (e.g., counterclockwise) at a speed substantially equal to that of said yarn plugs; sensing the lateral position of said cartridge at a point where continued rotation would cause said yarn plugs to fall at one extreme (e.g., innermost) section of the storage area in about 0.01 to 1 second; laterally shifting said cartridge to cause said yarn plugs to fall along the opposite side of said storage area by rotating said cartridge in the opposite direction (e.g., clockwise) at a speed substantially equal to that of said yarn plugs; sensing the lateral position of said cartridge at a point where continued rotation would cause yarn plugs to fall at the other extreme (e.g., outermost) section of the storage area in about 0.01 to 1 second; laterally shifting said cartridge to cause it to rotate in the original direction; continuously feeding yarn plugs into said cartridge by causing it repeatedly to rotate in one direction, shift, rotate in the opposite direction and shift; and removing said plug-containing cartridge from beneath the texturizer outlet. Since the plugs typically travel at about 1% of the yarn speed, the plug takeup can operate at a low speed, permitting simple design and low cost. The invention does not require a specially designed texturizer for its operation, and there is no need to wrap the yarn plugs.

After plugs have been deposited in a cartridge, the cartridge may be removed from the apparatus. The yarn plugs may then be pulled out over a tension gate, wound on a beam and later on knitted or weaved into fabric. Of course, many tens or hundreds of cartridges (i.e. yarn ends) may be required for the beaming operation. Alternatively, the cartridge may be used to feed a knitter directly.

BRIEF DESCRIPTION OF THE DRAWINGS

The invention will be better understood and additional advantages will become apparent when reference is made to the following description and accompanying drawings in which.

DESCRIPTION OF THE PREFERRED EMBODIMENTS

Figure 1:
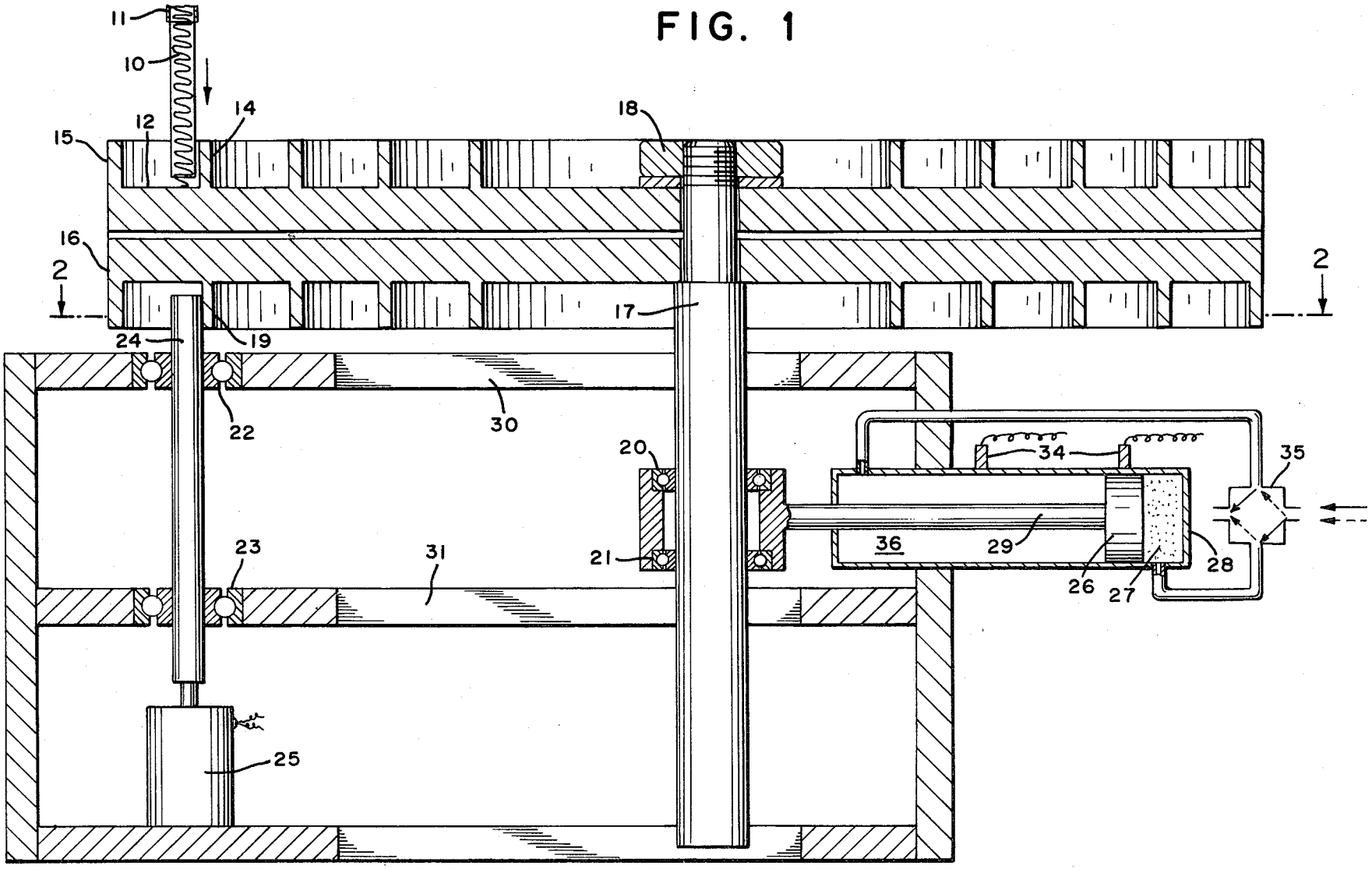
FIG. 1 is a vertical section of the preferred cartridge takeup apparatus of this invention.

Referring to the drawings in more detail, FIG. 1 shows a vertical section of the preferred embodiment of this invention. The textured yarn plug 10 emerges from a texturizer outlet 11 and impinges on the floor 12 of a section of a spiral groove of a cartridge 15, said groove formed by spiral wall 14. It is important that the yarn plug first contact the floor of the cartridge rather than the wall. If it first touches the wall surface, the wall friction slows down the plug and causes pilling up in random fashion. This results in severe entanglement during unwinding in a later stage. Cartridge 15 is fastened to support 16 and shaft 17 by a nut 18 on the threaded end of the shaft. Support 16 has an inverted spiral wall 19, the shape of said wall corresponding substantially to the shape of said cartridge wall 14. Bearings 20 and 21 prevent tilting of shaft 17. Rotor drive 24, retained by bearings 22 and 23 and driven by constant speed motor 25, rotates about a vertical axis, which passes through or near the center of texturizer outlet 11. During operation, texturizer outlet 11 and the axis of rotor drive 24 both remain fixed in space. Rotor drive 24 is in intimate contact with the wall 19 of support 16 to substantially prevent slipping. A piston 26 is powered by air or other compressible fluid in section 27 of cyclinder 28. The piston maintains intimate contact between rotor drive 24 and support wall 19 by exerting a lateral force through rod 29 and shaft 17. Shaft 17 slides in slots 30 and 31. Motor 25 drives support 16 at a constant speed, which is chosen to equal the speed of plug 10 as it impinges on the floor 12 of the cartridge groove. The plug speed is preferably about 1–1000 m per min, corresponding to yarn speeds up to about 10,000 m per min or more.

Figure 2B:
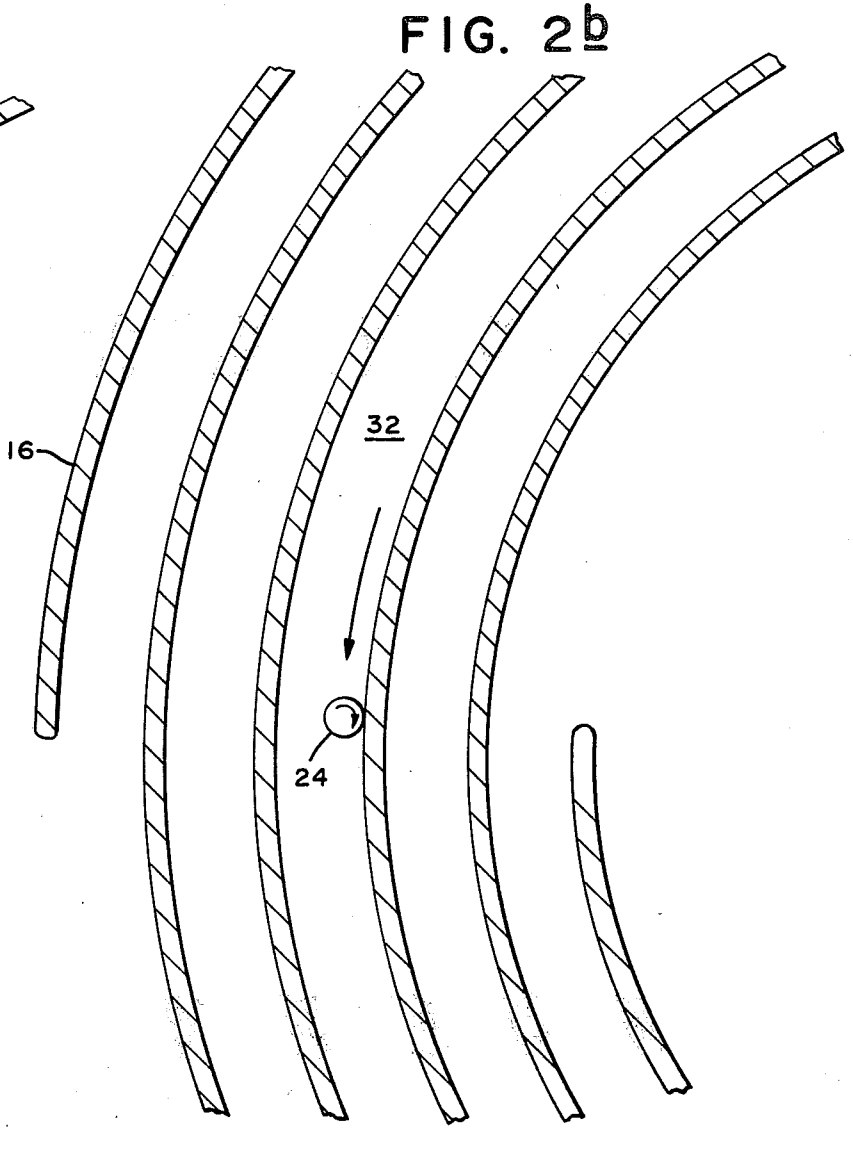
FIGS. 2*a, b, c* and *d* are each a horizontal section taken along the line 2—2 of FIG. 1 and show the rotor and support wall positions at successive time periods of the takeup cycle.
Figure 2A:
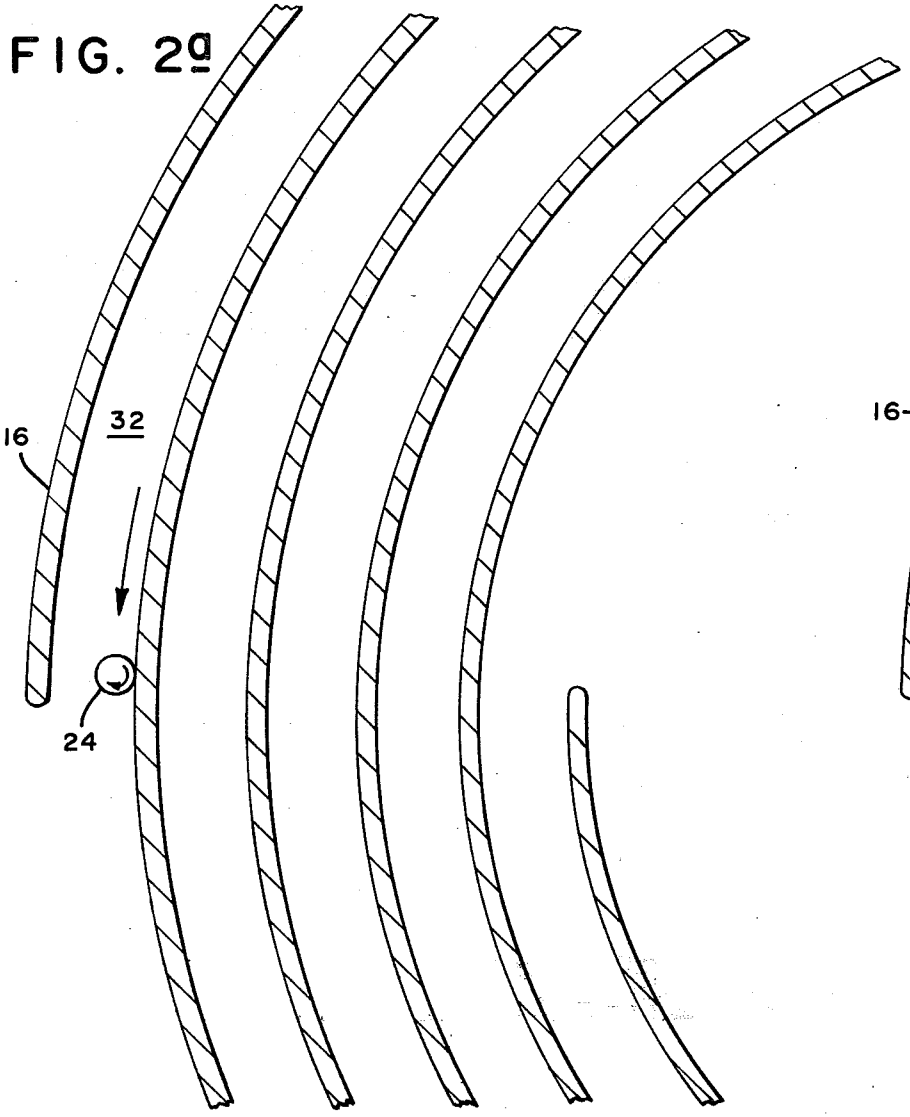
Figures 2C, 2D:
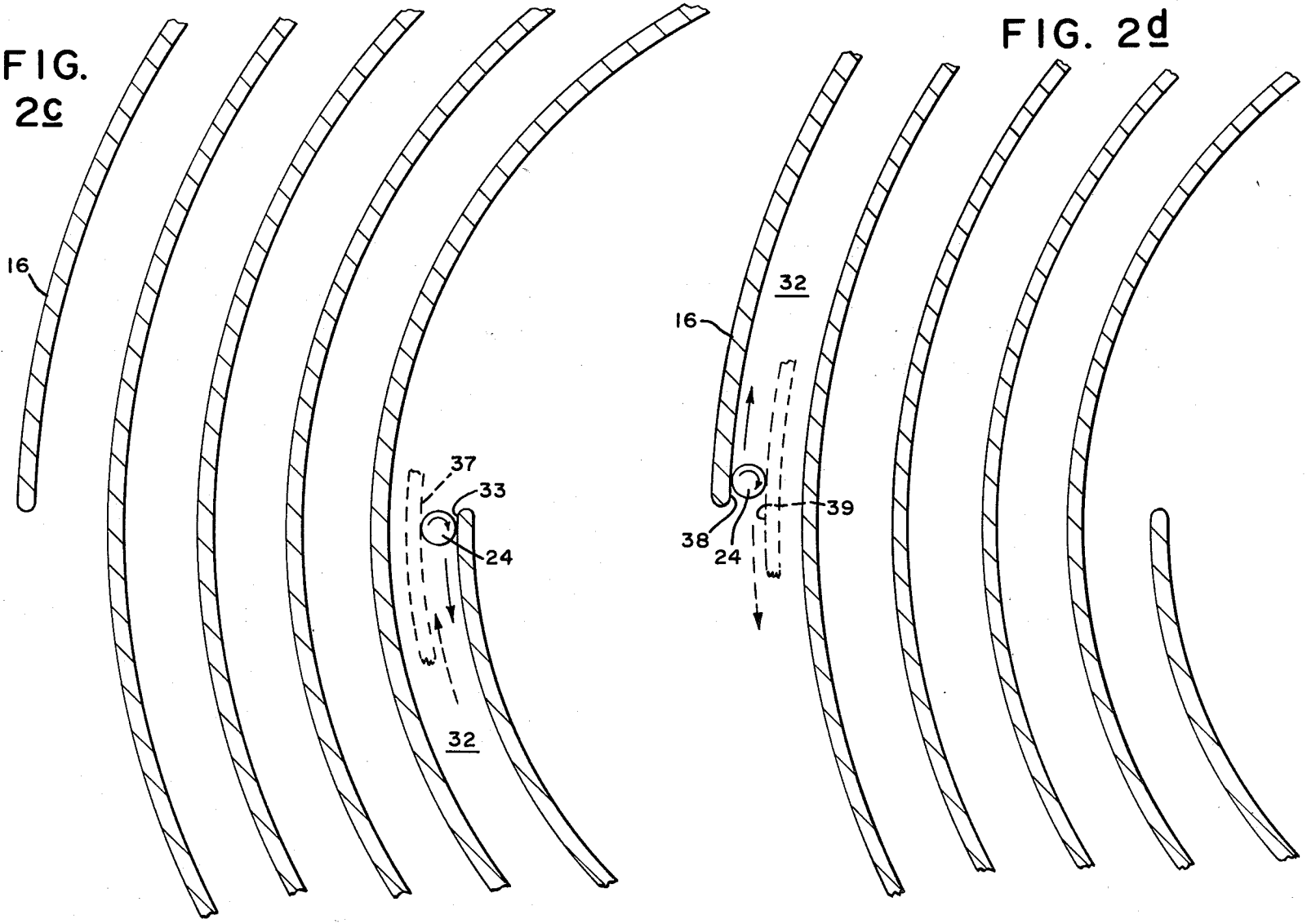

The position of rotor drive 24 near the outer edge of spiral groove 32 is shown in FIG. 2*a*. As the rotor drive rotates in a clockwise fashion, the support rotates counterclockwise and moves laterally to the left under the force of piston 26. FIG. 2*b* shows the position of support 16 at a later time, when it has been pushed to the left a distance twice the sum of groove plus wall width. FIG. 2*c* depicts the position of support 16 when the extreme inner section of wall 33 of spiral groove 32 has reached the rotor drive. At that point, sensor 34 activates solenoid-controlled 4-way valve 35 which switches the air flow to section 36 of cylinder 28. Piston 26 moves to the right, driving the takeup to the right and causing rotor drive 24 to come into contact with the opposite section of wall 37 (dashed line) of spiral groove 32. Thence, the continued clockwise rotation of rotor drive 24 drives the takeup clockwise. FIG. 2*d* depicts the position of support 16 when the extreme outer section of wall 38 has reached the rotor drive. Sensor 34 activates solenoid-controlled 4-way valve 35, which switches the air flow back into section 27 of cylinder 28. Piston 26 moves to the left, driving the takeup to the left and causing the opposite section of wall 39 to come into contact with rotor drive 24. The takeup is driven counterclockwise, and the sequence depicted in FIGS. 2*a,b,c,* and *d* repeats.

In the preferred embodiment, sensor 34 is a magnetic relay switch which detects the position of piston 26 and activates a solenoid-controlled 4-way valve 35. A person skilled in the art will recognize that other sensing means, e.g., mechanical or photo detectors, could serve in place of the magnetic sensor.

The yarn plugs may be composed of any suitable filamentary material including material chosen from the group consisting of poly 1,4-cyclohexylenedimethylene terephthalate, polyethylene terephthalate, polyhexamethylene adipamide, poly ϵ-aminocaproic acid, polypropylene, cellulose acetate, cellulose triacetate and glass. The plug density is preferably in a range from 5% to 75%, where plug density is defined as the ratio of the weight per unit volume of plug to the weight per unit volume of solid filamentary material. The plug cross-section may be substantially round, rectangular, or square, with plug size ranging from about 0.05 cm to 8.0 cm on a side or the equivalent.

Figure 3:
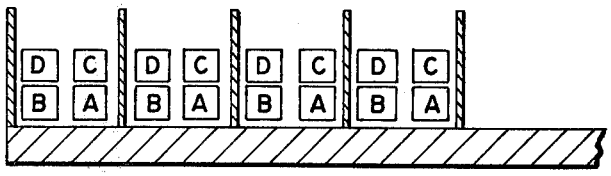
FIG. 3 is a fragmentary vertical section through a diameter of a partially filled cartridge.

FIG. 3 shows the arrangement of the yarn plugs in the cartridge. To achieve this arrangement of plugs, the rotor drive diameter must be less than half the groove width. Section "A" is deposited during the counterclockwise rotation of the cartridge as depicted in FIGS. 2*a* and 2*b*. Section "B" is deposited during the interval between FIG. 2*c* and 2*d*. During the following cycle, sections "C" and "D" are deposited in that order. When sufficient yarn plugs have been deposited, the cartridge 15 may be removed from the apparatus by removing nut 18 and replaced with an empty cartridge. The cartridge, functioning similarly to a conventional bobbin, should be relatively low cost.

Figure 4:
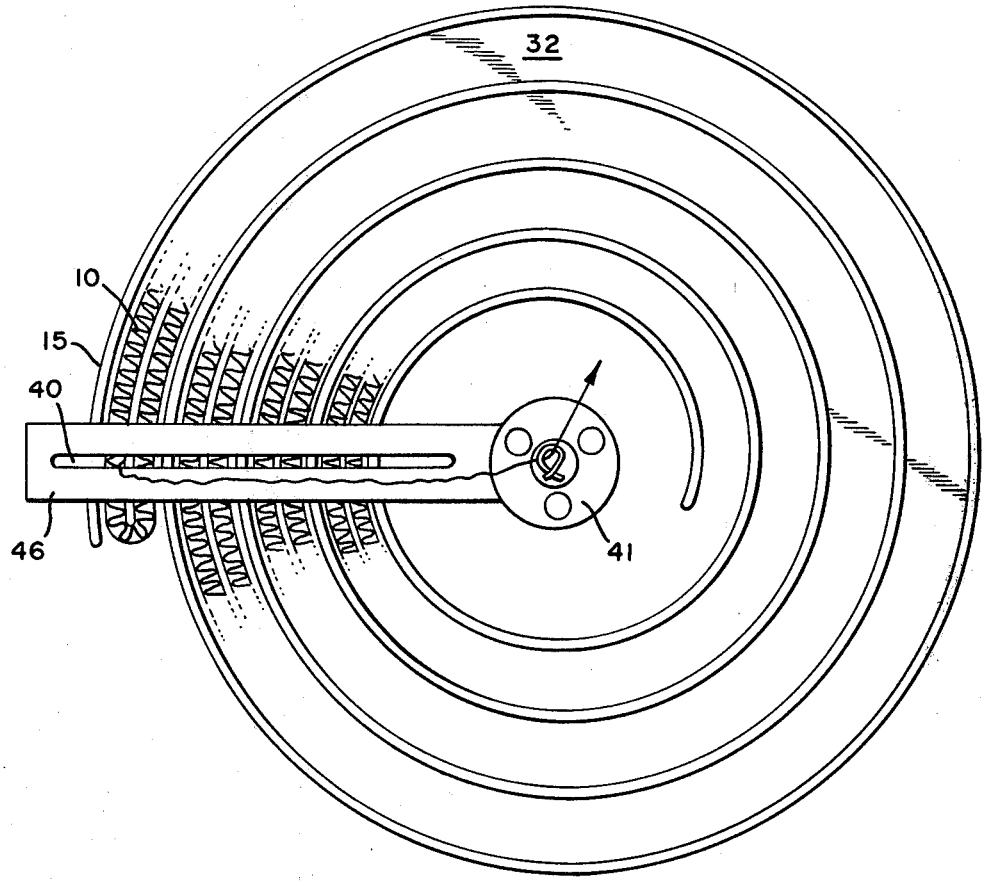
FIG. 4 is a top view of a filled cartridge and yarn take-off.

FIG. 4 shows cartridge 15 containing plugs 10 and being unwound through an arm 46 having a slit 40. The arm is mounted on low-friction bearings 41 which rotate freely as the textured yarn is pulled out through the slit. Arm rotation is alternately clockwise and counterclockwise, with rotation direction reversing when yarn is being withdrawn from the outer and inner sections of groove 32.

Figure 5:
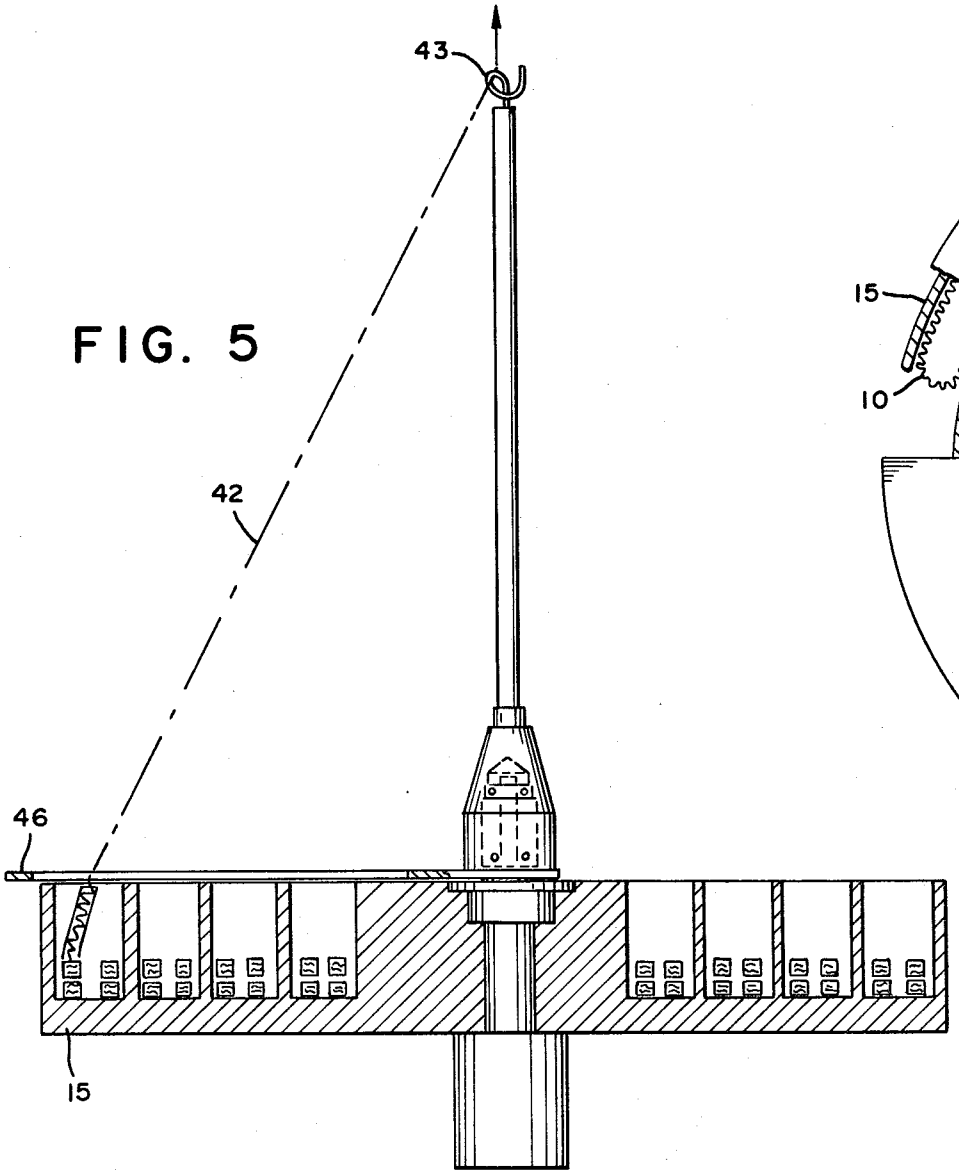
FIG. 5 is a side view of the cartridge and yarn take-off.

FIG. 5 shows textured yarn 42 being pulled from cartridge 15 through the slit in arm 46 and through pigtail 43. Thence the yarn goes over a tension gate and may either be wound on a beam or go directly to a knitter.

Figure 6:
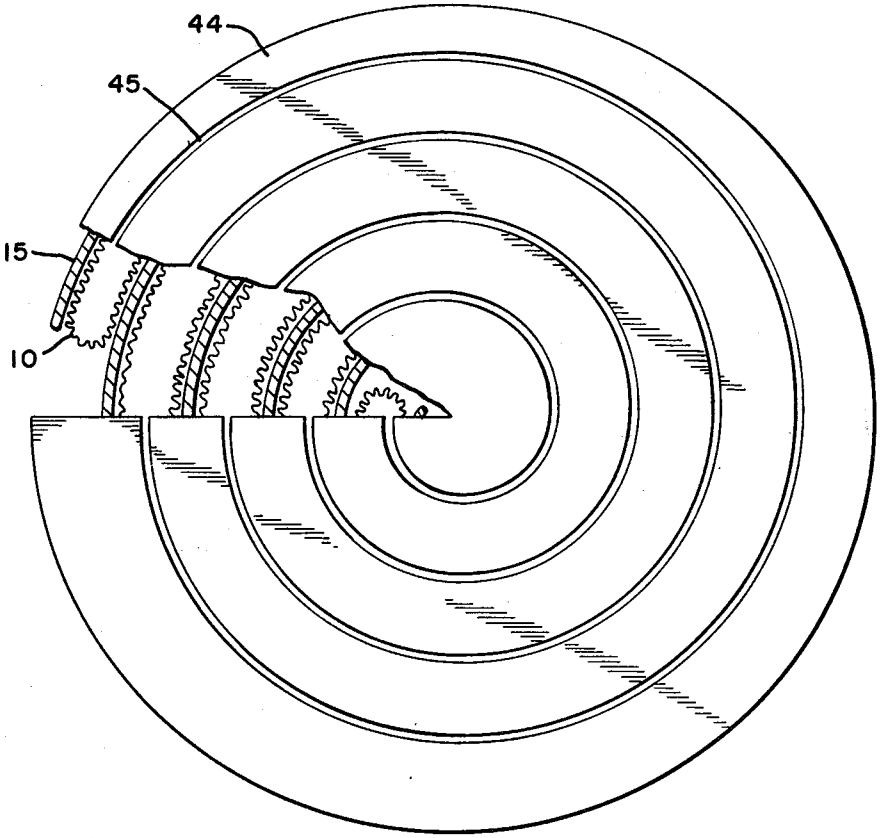
FIG. 6 is a top view of an alternative embodiment of this invention.

Alternatively, as shown in FIG. 6, the plug-containing cartridge may be covered with a closure (cap) 44. The cap has a spiral slit 45 so positioned that when cap 44 is on cartridge 15, slit 45 is located substantially over the center of the spiral groove in cartridge 15. The yarn 10 may be unwound through slit 45 in cap 44 without using arm 46.

The following example is presented in order to provide a more complete understanding of the invention. The specific techniques, conditions, materials and reported data set forth to illustrate the principles and practice of the invention are exemplary and should not be construed as limiting the scope of the invention.

EXAMPLE

The cartridge of FIG. 1 comprised a base of polycarbonate board, 30.5 cm diameter×0.64 cm thick, on which was glued a spiral wall of polycarbonate sheet, 6.4 cm high×0.13 cm thick×178 cm long, with a pitch of 1.9 cm. The support comprised a spiral wall of low carbon steel, 1.3 cm high×0.05 cm thick×178 cm long with a pitch of 1.9 cm glued on a base of polycarbonate board, 30.5 cm diameter×0.64 cm thick. The flat surfaces of the cartridge and support bases were bolted together. A double action air cylinder under pressure of about 700 dynes/cm$^2$ acting through the piston rod pushed the spiral wall of the support against a rotor to cause frictional drive. The rotor had a diameter of 1.3 cm and had a thin rubber strip wrapped around it. The rotor rotated clockwise at a substantially constant rate of about 290 rpm, yielding a cartridge speed of 12 m per min.

The yarn used was nylon 6, 35 denier/12 filaments. If was formed by the yarn texturizer into square plugs about 0.14 cm on a side and having a density of about 15%. The texturing speed was about 1,000 m per min. and the plug speed about 12 m per min.

Referring to FIG. 2*a*, the yarn plug deposition began with the rotor drive near the outer edge of spiral groove 32. The rotor drove the spiral wall surface in a counterclockwise direction, the plugs deposited during this period being shown as section "A" in FIG. 3. During the period, the support was driven laterally by the piston a distance of 2.8 cm, the travel preset by positioning the magnetic sensors. A magnetic sensor then activated a solenoid-controlled 4-way valve. The support was thus shifted laterally and the rotor drive contact point also shifted from the outside of the spiral wall to the inside. Then, while the rotor still rotated clockwise, the spiral wall also was driven clockwise. During clockwise rotation, plugs were deposited (section "B" in FIG. 3) in the groove alongside the plugs deposited (section "A" in FIG. 3) during counterclockwise rotation. After the clockwise rotation of the spiral had brought the rotor into contact with the outer section of the wall as shown in FIG. 2*d*, the solenoid valve was again activated, the takeup shifted and the cycle repeated until the groove was filled with 50 g of plugs.

The cartridge was removed from the apparatus and the textured yarn removed through a slit in a rotating arm as shown in FIGS. 4 and 5. The yarn was wound on a bobbin at 500 m per min. The yarn was knitted on a Lawson-Hemphill Fiber Analysis Knitter having a 54 gauge head, 220 needles, a diameter of 8.9 cm and 91 cm per course. The knitted fabric, when dyed, showed good texture and uniformity.

We claim:

1. A takeup apparatus for packaging yarn plugs comprising:

(a) a cartridge adapted for receiving yarn plugs from a yarn texturizer and having a storage groove formed by a spiral wall;

(b) a support for the base of said cartridge, said support having a spiral wall extending downward, the shape of said support spiral wall corresponding substantially to the shape of said cartridge spiral wall;

(c) a shaft upon which said support is mounted;

(d) means for driving said support around said shaft by contacting the spiral wall of said support with a driving means;

(e) means for applying a lateral force to said shaft to hold the spiral wall of said support in non-slip contact with said driving means;

(f) means for sensing the lateral position of said support; and (g) means for changing reversibly the direction of said lateral force such that the contact point of the driving means shifts from a point on the inside of the support spiral wall to a point on the outside of the support spiral wall.

2. An apparatus according to claim 1, wherein said means for driving said support comprises a rotating member.

3. An apparatus according to claim 2, wherein the diameter of said rotating member is less than one-half the width of the storage groove.

4. An apparatus according to claim 1, wherein said means for applying a lateral force to said shaft comprises a fluid driven piston disposed in a double action cylinder.

5. An apparatus according to claim 1, further comprising a closure for the cartridge, said closure having a spiral slit disposed substantially above the center of the spiral storage area of said cartridge.

6. A method of taking up yarn plugs from a texturizer comprising:

(a) locating beneath the texturizer outlet a cartridge having a spiral storage area;

(b) causing said yarn plugs to fall along one side of the spiral storage area by rotating said cartridge in one direction at a speed substantially equal to that of said yarn plugs;

(c) sensing the lateral position of said cartridge at a point where continued rotation would cause said yarn plugs to fall at an extreme section of the storage area in about 0.01 to 1 second;

(d) laterally shifting said cartridge to cause said yarn plugs to fall along the opposite side of said storage area by rotating said cartridge in the opposite direction at a speed substantially equal to that of said yarn plugs;

(e) sensing the lateral position of said cartridge at a point where continued rotation would cause said yarn plugs to fall at the other extreme section of the storage area in about 0.01 to 1 second;

(f) laterally shifting said cartridge to cause it to rotate in the original direction;

(b) continuously feeding yarn plugs into said cartridge by causing it repeatedly to rotate in one direction, shift, rotate in the opposite direction and shift; and (h) removing said plug-containing cartridge from beneath said texturizer outlet.

7. The method of claim 6 wherein said cartridge is rotated by contacting a rotating member.

8. The method of claim 6 wherein said cartridge is shifted by a fluid driven piston disposed in a double action cylinder.

9. The method of claim 6 wherein said plug-containing cartridge is covered with a closure and yarn is removed through a spiral slit in the closure disposed substantially above the center of the spiral storage area of said cartridge.

* * * * *